United States Patent [19]

Gaggianese

[11] Patent Number: 4,865,285

[45] Date of Patent: Sep. 12, 1989

[54] MAGNETIC PENHOLDER AND MAGNETIC PEN SET

[75] Inventor: Giancarlo Gaggianese, Turin, Italy

[73] Assignee: Winninghorse, SRL, Turin, Italy

[21] Appl. No.: 216,327

[22] Filed: Jul. 7, 1988

[30] Foreign Application Priority Data

Jan. 13, 1988 [IT] Italy ..... 5281688[U]

[51] Int. Cl.[4] ..... B43K 29/00

[52] U.S. Cl. ..... 248/309.4; 401/131; 211/69.1; 211/DIG. 1; 335/285

[58] Field of Search ..... 248/206.5, 309.4, 359 A; 211/DIG. 1, 69.1; 206/818, 371; 24/303; 40/905; 335/285, 219; 223/109 A; 401/88, 131; D19/81, 83, 84, 85

[56] References Cited

U.S. PATENT DOCUMENTS

| | | | |
|---|---|---|---|
| 2,297,806 | 10/1942 | Smith | 211/DIG. 1 |
| 2,386,500 | 10/1945 | Parker | 211/69.1 |
| 2,414,653 | 1/1947 | Lookholder | 24/303 |
| 2,455,506 | 12/1948 | Leslie | 211/DIG. 1 |
| 2,457,421 | 12/1948 | Warren | 223/109 A |
| 2,503,061 | 4/1950 | Moholy-Nagy | 211/DIG. 1 |
| 2,693,788 | 11/1953 | Spatz | 211/69.1 |
| 2,825,177 | 3/1958 | Nordlof | 248/309.4 |
| 4,643,604 | 2/1987 | Enrico | 211/DIG. 1 |

FOREIGN PATENT DOCUMENTS

| | | | |
|---|---|---|---|
| 1029451 | 6/1953 | France | 24/303 |
| 1539160 | 8/1968 | France | 211/69.1 |
| 497982 | 9/1954 | Italy | 211/69.1 |
| 646854 | 11/1950 | United Kingdom | 211/DIG. 1 |

*Primary Examiner*—Ramon O. Ramirez
*Assistant Examiner*—Robert A. Olson
*Attorney, Agent, or Firm*—Majestic, Parsons, Siebert & Hsue

[57] ABSTRACT

A magnetic penholder and magnetic pen set which comprises a base (1) with magnet (5) therein with one magnetic pole facing upwards. Pen (2) includes a magnet (8) therein which is attracted by the magnet (5) of the base, so that the pen will rotate until an opposite pole is exposed. The curved surface of the base provides substantially a point area of contact between the base and pen.

4 Claims, 2 Drawing Sheets

MAGNETIC PENHOLDER AND MAGNETIC PEN SET

This invention relates to a magnetic penholder and magnetic pen set.

The scope of the present inventin is to create a penholder and pen set such as to place the pen within reach of the person writing in a simple manner and without it being necessary to look for a specific position of the pen in the penholder, but on the contrary such that it is sufficient to bring the pen close to the penholder for the former to be held. This and other aims and advantages of the invention, as disclosed by the rest of this specification, are achieved by a magnetic penholder and magnetic pen set characterised by the fact that the penholder constitutes the supporting base for the pen and for this purpose houses a magnet with one pole facing upwards, the said pen also containing along its centre line a magnet attracted by the said penholder magnet and being therefore held on the penholder itself.

A description will now be given of a preferred embodiment of the invention by means of a non-limiting example only and with reference to the attached drawings, in which.

Figure 1:
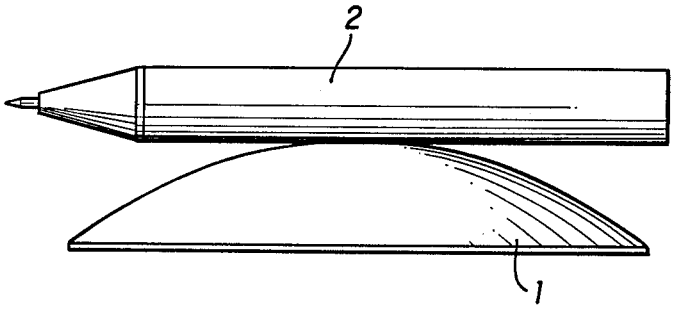
FIG. 1 is an elevation view of the penholder and pen set according to the invention.
Figure 2:
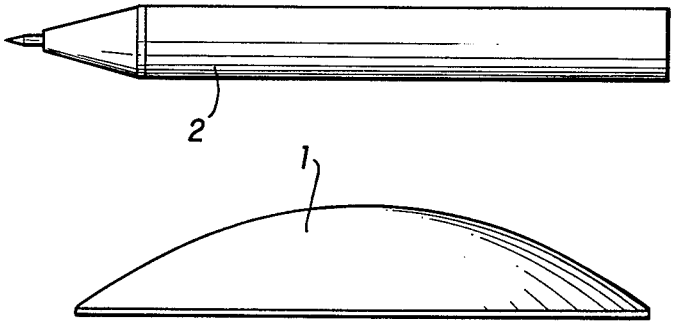
FIG. 2 is an elevation view of the penholder and the pen separately.
Figure 3:
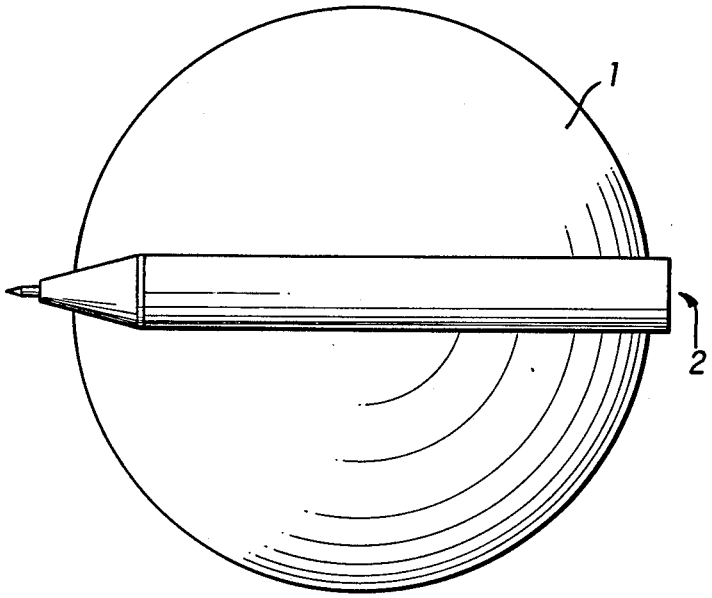
FIG. 3 is a plan view from above of the set in FIG. 1.

With reference to FIG. 1, 1 is a magnetic penholder acting as the base for a pen 2, also magnetic.

In the example shown in the drawing, the penholder 1 is in the form of a spherical dome, whereas other shapes are obviously possible without thereby going outside the ambit of the invention.

Figure 4:
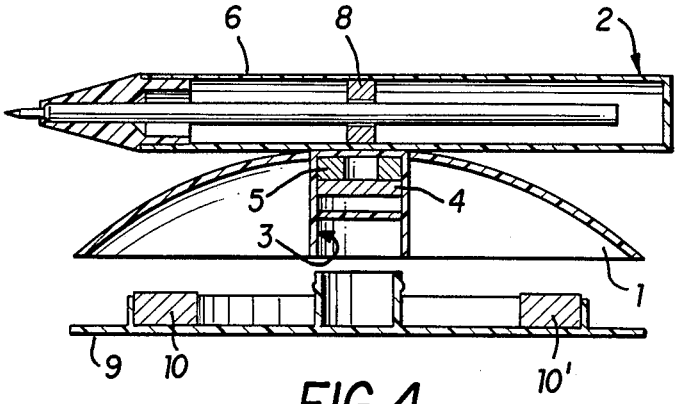
FIG. 4 is a partly exploded section view of the set in FIG. 1.

In the central part of the penholder 1, there is provided a cavity 3 opening downwards (FIG. 4) within which is inserted a magnet 5 producing a magnetic field directed toward the summit of the said dome which is free of openings therethrough, the said magnet 5 being supported and strengthened by a metal disk 4. The penholder 1 also comprises a base 9 with a central tube to be inserted in the cavity 3 of the penholder. Suitable weights 10,10' are lodged in the base 9 to give it extra weight and make it stable.

The invention also relates to a magnetic pen 2 intended to be positioned above the penholder 1. The pen

2 is composed of a (for example) cylindrical body 6 in the center line of which is housed a second magnet 8 producing a magnetic field acting outside the pen 2.

On bringing the pen 2 close to the summit of the penholder and turning the pen so that the magnet it houses exposes in the direction of magnet 5 a pole opposite to that of the latter, there will be determined between the two said magnets a force of atraction that will hold the pen on the penholder, even if the area of contact between the two is very small and even if the center of gravity of the pen does not fall within the said area.

In addition, whenever the pen is brought close to the penholder in such an attitude that its own magnet exposes the same polarity as that of the penholder, the repulsion between two will rotate the pen about its axis until it exposes the opposite pole, with the result that in every case the attraction and hence the retention of the pen on the penholder will be automatically brought about.

When has been described is a preferred embodiment of the invention. It is obvious that the said embodiment is open to numerous modifications and variations within the ambitof the same innovation idea.

I claim:

1. Magnetic penholder and magneticpen set characterised by the fact that the penholder (1) constitutes the supporting base of the pen (2) and for this purpose houses a magnet (5) with one pole facing upwards, the said pen also containing along its center line a magnet (8) attracted by the said magnet (5) and being therefore held on the penholder itself, the penholder being free of apertures therethrough and providing substantially a point area of contact betwen an upper curved surface of said base and said pen, the repulsion created by the polarity between said two magnets will rotate said pen until it exposes an opposite pole.

2. Magnetic penholder and magnetic pen set as in claim 1 wherein the said penholder curved surface has the form of a spherical dome defining a summit so that said point area of contact is between said summit and said magnetic pen.

3. Magnetic penholder and magnetic pen set as in claim 2 wherein the said magnet (5) of the said penholder is housed in a cavity (3) opening downwards and provided in the centre of the said spherical dome.

4. Magnetic penholder and magnetic pen set as in claim 3 further including a disk (4) retaining said magnet (5) in said cavity (3).

* * * * *